US007871133B2

(12) United States Patent
Hall et al.

(10) Patent No.: US 7,871,133 B2
(45) Date of Patent: Jan. 18, 2011

(54) LOCKING FIXTURE

(75) Inventors: David R. Hall, Provo, UT (US); Scott Dahlgren, Alpine, UT (US)

(73) Assignee: Schlumberger Technology Corporation, Houston, TX (US)

( * ) Notice: Subject to any disclaimer, the term of this patent is extended or adjusted under 35 U.S.C. 154(b) by 362 days.

(21) Appl. No.: 12/112,815

(22) Filed: Apr. 30, 2008

(65) Prior Publication Data

US 2008/0197692 A1 Aug. 21, 2008

Related U.S. Application Data

(63) Continuation of application No. 12/112,743, filed on Apr. 30, 2008, which is a continuation of application No. 12/051,738, filed on Mar. 19, 2008, now Pat. No. 7,669,674, which is a continuation of application No. 12/051,689, filed on Mar. 19, 2008, which is a continuation of application No. 12/051,586, filed on Mar. 19, 2008, which is a continuation-in-part of application No. 12/021,051, filed on Jan. 28, 2008, which is a continuation-in-part of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 12/112,815, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(51) Int. Cl.
*E21C 35/197* (2006.01)

(52) U.S. Cl. ..... 299/113; 403/30; 29/447; 299/111; 299/104; 299/102; 299/107

(58) Field of Classification Search ..... 299/79.1, 299/104, 105, 106, 107, 102, 111, 113; 29/447; 403/265, 269, 355, 30
See application file for complete search history.

(56) References Cited

U.S. PATENT DOCUMENTS 2,004,315 A 6/1935 Fean (Continued)

*Primary Examiner*—John Kreck
(74) *Attorney, Agent, or Firm*—Holme Roberts & Owens LLP

(57) ABSTRACT

In one aspect of the invention, a degradation assembly comprises an impact tip brazed to a carbide bolster. A stem protrudes from the bolster, being adapted to be retained within a bore connected to a driving mechanism. A locking fixture is disposed within the bore and locking the stem to a wall of the bore.

20 Claims, 15 Drawing Sheets

U.S. PATENT DOCUMENTS 2,124,438 A 7/1938 Struk
2,972,713 A * 2/1961 Sutton, Jr. ..... 361/746
3,089,215 A * 5/1963 Stubbs ..... 425/111
3,254,392 A 6/1966 Novkov
3,746,396 A 7/1973 Radd
3,807,804 A 4/1974 Kniff
3,830,321 A 8/1974 McKenry
3,932,952 A 1/1976 Helton
3,945,681 A 3/1976 White
4,005,914 A 2/1977 Newman
4,006,936 A 2/1977 Crabiel
4,098,362 A 7/1978 Bonnice
4,109,737 A 8/1978 Bovenkerk
4,156,329 A 5/1979 Daniels
4,199,035 A 4/1980 Thompson
4,201,421 A 5/1980 Den Besten
4,277,106 A 7/1981 Sahley
4,439,250 A 3/1984 Acharya
4,465,221 A 8/1984 Schmidt
4,484,644 A 11/1984 Cook
4,489,986 A 12/1984 Dziak
4,678,237 A 7/1987 Collin
4,682,987 A 7/1987 Brady
4,688,856 A 8/1987 Elfgen
4,725,098 A 2/1988 Beach
4,729,603 A 3/1988 Elfgen
4,765,686 A 8/1988 Adams
4,765,687 A 8/1988 Parrott
4,776,862 A 10/1988 Wiand
4,880,154 A 11/1989 Tank
4,932,723 A 6/1990 Mills
4,940,288 A 7/1990 Stiffler
4,944,559 A 7/1990 Sionnet
4,951,762 A 8/1990 Lundell
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,261,499 A 11/1993 Grubb
5,332,348 A 7/1994 Lemelson
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,713,412 A * 2/1998 Wepfer et al. ..... 165/69
5,738,698 A 4/1998 Kapoor
5,823,632 A 10/1998 Burkett
5,837,071 A 11/1998 Anderson
5,845,547 A 12/1998 Sollami
5,875,862 A 3/1999 Jurewicz
5,934,542 A 8/1999 Nakamura
5,935,718 A 8/1999 Demo
5,944,129 A 8/1999 Jenson
5,967,250 A 10/1999 Lund
5,992,405 A 11/1999 Sollami
6,006,846 A 12/1999 Tibbitts
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,499,547 B2 12/2002 Scott
6,517,902 B2 2/2003 Drake
6,585,326 B2 7/2003 Sollami
6,685,273 B1 2/2004 Sollami
6,692,083 B2 2/2004 Latham
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,786,557 B2 9/2004 Montgomery, Jr.
6,824,225 B2 11/2004 Stiffler
6,851,758 B2 2/2005 Beach
6,854,810 B2 2/2005 Montgomery, Jr.
6,861,137 B2 3/2005 Griffin et al.
6,889,890 B2 5/2005 Yamazaki
6,966,611 B1 11/2005 Sollami
6,994,404 B1 2/2006 Sollami
7,204,560 B2 4/2007 Mercier
2002/0175555 A1 11/2002 Mercier
2003/0141350 A1 7/2003 Noro et al.
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2005/0173966 A1 8/2005 Mouthaan
2006/0237236 A1 10/2006 Sreshta

* cited by examiner

LOCKING FIXTURE

CROSS REFERENCE TO RELATED APPLICATIONS

This application is a continuation of U.S. patent application Ser. No. 12/112,743 filed Apr. 30, 2008 which is a continuation of U.S. patent application Ser. No. 12/051,738 filed Mar. 19, 2008 now U.S. Pat. No. 7,669,674 which is a continuation of U.S. patent application Ser. No. 12/051,689 filed Mar. 19, 2008 which is a continuation of U.S. patent application Ser. No. 12/051,586 filed Mar. 19, 2008 which is a continuation-in-part of U.S. patent application Ser. No. 12/021,051 filed Jan. 28, 2008 which is a continuation-in-part of U.S. patent application Ser. No. 12/021,019 filed Jan. 28, 2008 which was a continuation-in-part of U.S. patent application Ser. No. 11/971,965 filed Jan. 10, 2008 now U.S. Pat. No. 7,648,210 which is a continuation of U.S. patent application Ser. No. 11/947,644, filed Nov. 29, 2007 which was a continuation-in-part of U.S. patent application Ser. No. 11/844,586 filed Aug. 24, 2007 now U.S. Pat. No. 7,600,823. U.S. patent application Ser. No. 11/844,586 is a continuation-in-part of U.S. patent application Ser. No. 11/829,761 filed Jul. 27, 2007 now U.S. Pat. No. 7,722,127. U.S. patent application Ser. No. 11/829,761 is a continuation-in-part of U.S. patent application Ser. No. 11/773,271 filed Jul. 3, 2007. U.S. patent application Ser. No. 11/773,271 is a continuation-in-part of U.S. patent application Ser. No. 11/766,903 filed Jun. 22, 2007. U.S. patent application Ser. No. 11/766,903 is a continuation of U.S. patent application Ser. No. 11/766,865 filed Jun. 22, 2007. U.S. patent application Ser. No. 11/766,865 is a continuation-in-part of U.S. patent application Ser. No. 11/742,304 filed Apr. 30, 2007 now U.S. Pat. No. 7,475,948. U.S. patent application Ser. No. 11/742,304 is a continuation of U.S. patent application Ser. No. 11/742,261 filed Apr. 30, 2007 now U.S. Pat. No. 7,469,971. U.S. patent application Ser. No. 11/742,261 is a continuation-in-part of U.S. patent application Ser. No. 11/464,008 filed Aug. 11, 2006 now U.S. Pat. No. 7,338,135. U.S. patent application Ser. No. 11/464,008 is a continuation-in-part of U.S. patent application Ser. No. 11/463,998 filed Aug. 11, 2006 now U.S. Pat. No. 7,384,105. U.S. patent application Ser. No. 11/463,998 is a continuation-in-part of U.S. patent application Ser. No. 11/463,990 filed Aug. 11, 2006 now U.S. Pat. No. 7,320,505. U.S. patent application Ser. No. 11/463,990 is a continuation-in-part of U.S. patent application Ser. No. 11/463,975 filed Aug. 11, 2006 now U.S. Pat. No. 7,445,294. U.S. patent application Ser. No. 11/463,975 is a continuation-in-part of U.S. patent application Ser. No. 11/463,962 filed Aug. 11, 2006 now U.S. Pat. No. 7,413,256. U.S. patent application Ser. No. 11/463,962 is a continuation-in-part of U.S. patent application Ser. No. 11/463,953 filed Aug. 11, 2006 now U.S. Pat. No. 7,464,993. The present application is also a continuation-in-part of U.S. patent application Ser. No. 11/695,672 filed Apr. 3, 2007 now U.S. Pat. No. 7,396,086. U.S. patent application Ser. No. 11/695,672 is a continuation-in-part of U.S. patent application Ser. No. 11/686,831 filed Mar. 15, 2007 now U.S. Pat. No. 7,568,770. All of these applications are herein incorporated by reference for all that they contain.

BACKGROUND OF THE INVENTION

Formation degradation, such as pavement milling, mining, or excavating, may be performed using impact resistant picks. These picks may be mounted to a driving mechanism in a variety of ways, some of which may be more effective in formation degradation applications than others. Thus, many efforts have been made to optimize the method of attachment to the driving mechanism.

BRIEF SUMMARY OF THE INVENTION

In one aspect of the invention, a degradation assembly includes an impact tip brazed to a carbide bolster. A stem protrudes from the bolster, being adapted to be retained within a bore connected to a driving mechanism. A locking fixture is disposed within the bore and locking the stem to a wall of the bore.

The carbide bolster may have a cavity formed in its base end and may be interlocked with the stem. The stem may be interlocked with the bolster through a threadform. The stem may be interlocked through at least one catch. The stem may be interlocked through a press fit. The stem may be formed of the same material as the bolster. The locking fixture may comprise a snap ring. The locking fixture may comprise a ring disposed around the stem. The ring may comprise at least one barb on its outer surface adapted to engage the wall of the bore. The locking fixture may have a threadform. The assembly may include a tensioning mechanism adapted to apply tension on the stem. The tensioning mechanism may be a shrunk material. The tensioning mechanism may include at least one threadform and a nut. The bolster may have a tapered base end. The bolster may have a lip adapted to accommodate the removal of the assembly from the bore.

In another aspect of the invention, a method for assembling a degradation assembly, may comprise the steps of providing the degradation assembly having an impact tip brazed to a carbide bolster with a stem protruding from the bolster being adapted to be retained within a bore connected to a driving mechanism. The method may further comprise the step of securing the stem within the bore by inserting the stem into the bore such that a locking fixture disposed around the stem permanently locks against a wall of the bore. The method may further comprise the step of adding a metal insert into the bore prior to securing the stem within the bore. The method further comprise the step of removing the assembly from the bore. The method may further comprise the step of inserting another degradation assembly with a shorter stem into the bore.

DETAILED DESCRIPTION OF THE INVENTION AND THE PREFERRED EMBODIMENT

Figure 1:
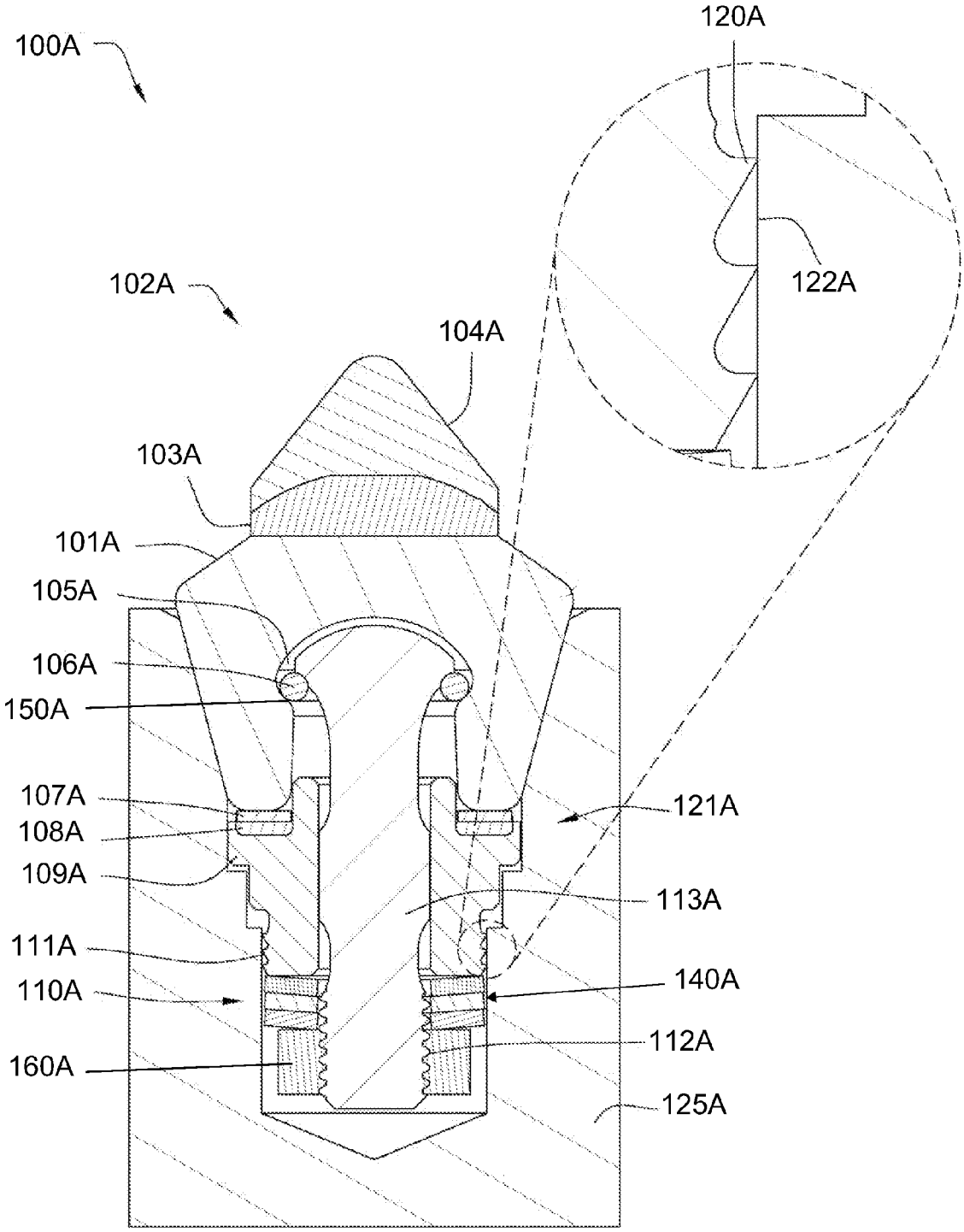
FIG. 1 is a cross-sectional view of an embodiment of a tool for use in a degradation assembly with a magnified portion.

FIG. 1 shows a cross-sectional diagram of an embodiment of a tool 100A for use in a degradation assembly inserted within a bore 121A of a driving mechanism 125A with a magnified portion. The degradation assembly 100A has an impact tip 102A attached to a carbide bolster 101A. In some embodiments, the impact tip 102A may comprise a superhard material 104A attached to a cemented metal carbide substrate 103A.

The super hard material 104A may be diamond, polycrystalline diamond with a binder concentration of 1 to 40 weight percent, cubic boron nitride, refractory metal bonded diamond, silicon bonded diamond, layered diamond, infiltrated diamond, thermally stable diamond, natural diamond, vapor deposited diamond, physically deposited diamond, diamond impregnated matrix, diamond impregnated carbide, monolithic diamond, polished diamond, course diamond, fine diamond, nonmetal catalyzed diamond, cemented metal carbide, chromium, titanium, aluminum, tungsten, or combinations thereof. The super hard material 104A may be a polycrystalline structure with an average grain size of 10 to 100 microns.

In this embodiment, the carbide bolster 101A has a cavity 105A into which a stem 113A is inserted. The stem 113A may be held in place using a snap ring 106A which is inserted into the cavity 105A and disposed between the stem 113A and a lip 150A of the bolster 101A.

A tightening assembly 140A within the tool 100A is adapted to apply tension between the bolster 101A and an anchor 111A through the stem 113A. Tightening assembly 100A may include springs 110A disposed around the stem 113A and adapted to push off the anchor 111A to apply tension to the stem 113A. An insert 109A is disposed around the stem 113A and between the bolster 101A and springs 110A. A threadform 112A may connect a nut 160A to the stem 113A to provide a surface for the spring 110A to load the stem 113A.

An anchor 111A may have barbs 120A that engage a wall 122A of the bore 121A of the driving mechanism 125A to secure an insert 109A within the bore 121A upon insertion of the tool 100A into the bore 121A. A steel ring 107A is disposed between the bolster 101A and a meltable spacer 108A.

The meltable spacer 108A is adapted to melt when heat is applied to the tool 100A through the carbide bolster 101A. As the meltable spacer 108A melts, the tension on the stem 113A pulls the bolster 101A closer to the anchor 111A, effectively tightening the connection. The tightening assembly 140A pulls on the carbide bolster 101A thus securing the bolster 101A to the driving mechanism 125A. The meltable spacer 108A may comprise lead, bismuth, tin, cadmium, wax, plastic or combinations thereof. The meltable spacer 108A may melt at a temperature significantly lower than the bolster 101A and/or stem 113A. The meltable spacer may be a ring, a shim, wedge, ball, cube, roller, arc segment, or combinations thereof. Preferably the meltable spacer 108A has a characteristic such that when it changes from a solid phase to a liquid phase, the phase change occurs rapidly. In some embodiments, the pull down stroke is no greater than an inch. In some embodiments, the lip the lip may be formed by molding, grinding, or a CNC process.

The springs 110A may be Bellville springs, biased rings, coil springs, gas springs, rubber, an elastomeric material or combinations thereof. The springs 110A may also provide the benefit of providing a variable pull down force on the bolster 101A. Often tools, such as tool 100A, will heat up while in operation causing all of the components to thermally expand. Often the bolster 101A will have a lower coefficient of thermal expansion that the material forming the bore wall 122A and therefore the bore wall 122A may want to separate from the bolster. The pull-down force of the springs 110A will keep the bolster 101A snug against the bore wall 122A under the differing temperature and expansion changes.

The invention is especially well suited for applications where inserts or some kind of connection is in needed to be made in a blind hole.

Figures 2A, 2B:
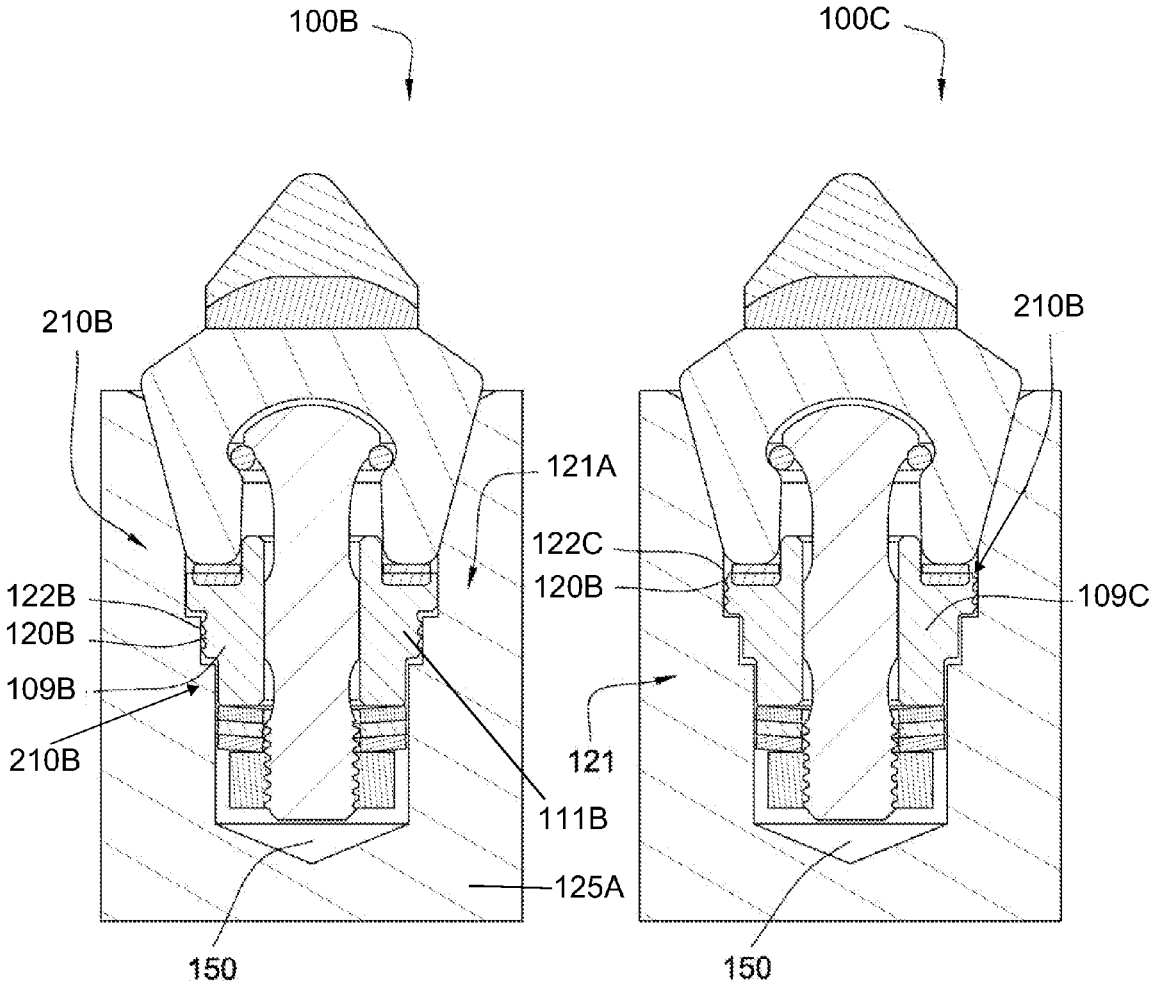
FIG. 2*a* is a cross-sectional view of another embodiment of a tool for use in a degradation assembly.
FIG. 2*b* is a cross-sectional view of another embodiment of a tool for use in a degradation assembly.

FIG. 2*a* shows a cross-sectional diagram of another embodiment of a tool 100B inserted within the bore 121A of the driving mechanism 125A. In this embodiment, a wall 122A of the bore 121A has a series of stepped notches 210B adapted to fit to an increased size of an insert 109B. After having used the tool 100A of FIG. 1, the used tool 100A is removed from the bore 121A and replaced with another assembly 100B. The newly inserted assembly 100B includes at least one barb 120B on an anchor 111B such that upon insertion of the tool 100B, the at least one barb 120B contacts the wall 122A of the bore 121A at a location different than where the previous barb 120A engaged the wall 122A of the bore 121A.

FIG. 2*b* shows another cross-sectional diagram of another embodiment of a tool 100C inserted within the bore 121A of the driving mechanism 125A. In this embodiment, the wall 121A of the bore 122A includes the series of stepped notches 210B adapted to fit to the increased size of the insert 109C. After having used a second tool 100B, the used tool 100B is removed from the bore 121A and replaced with another tool 100C. The newly inserted tool 100C has at least one barb 120C disposed such that upon insertion of the tool 100C, the at least one barb 120C contacts the wall 122A of the bore 121A farther from a bottom 150B of the bore 121A than a point of contact of the previous tool 100B.

Figure 3:
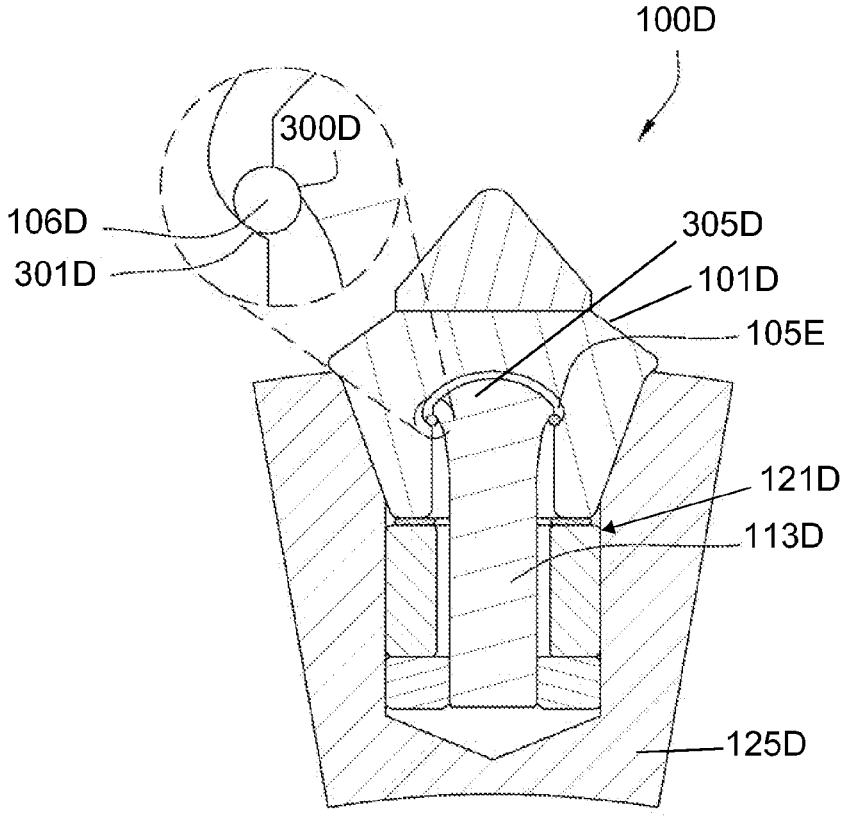
FIG. 3 is a cross-sectional view of another embodiment of a tool for use in a degradation assembly with a magnified portion.

FIG. 3 shows another cross-sectional diagram of another embodiment of a tool 100D inserted within a bore 121D of a driving mechanism 125D. A stem 113D is restricted from removal from a cavity 105D of a bolster 101D by a snap ring 106D disposed around the stem 113D and a notch 300D disposed on an enlarged portion 305D of the stem 113A. The snap ring 106A contacts a wall 301D of the cavity 105D and the notch 300D, thus restricting the removal of stem 113D from the cavity 105D.

Figure 4:
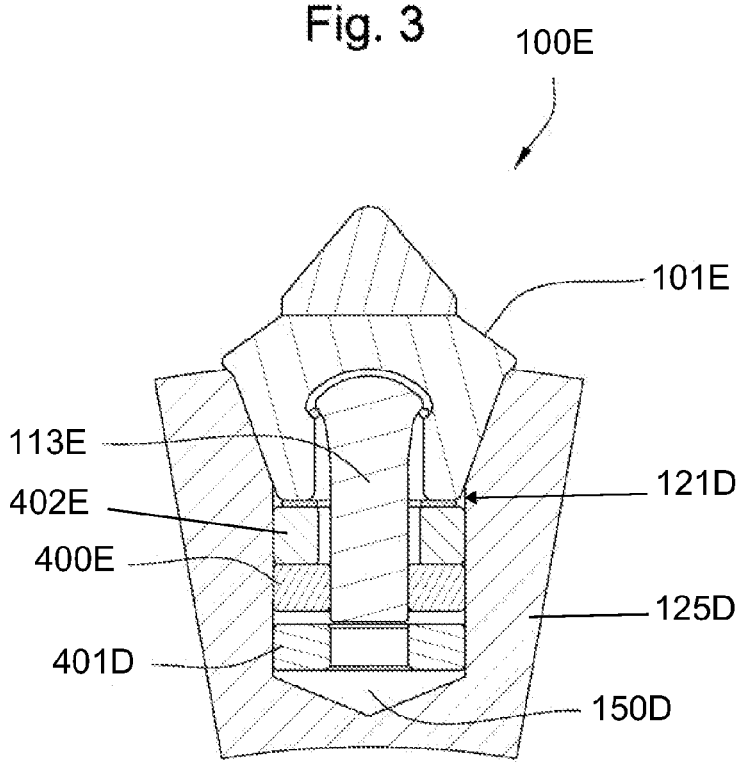
FIG. 4 is a cross-sectional view of another embodiment of a tool for use in a degradation assembly.

FIG. 4 shows another cross-sectional diagram of another embodiment of a tool 100E inserted within the bore 121D of the driving mechanism 125D of FIG. 3. A stem 113E may be secured to an anchor 400E through a press fit. The anchor 400E, in this embodiment, is disposed farther from a bottom 150E of the bore 121E than a previously used anchor 401D. A spacer 402E is disposed intermediate the anchor 400E and the bolster 101E. In other embodiments, the anchor 400E may be secured through threads, a hydraulically activated mechanism, inserts, wedges, balls, an interlocking geometry or combinations thereof.

Figure 5:
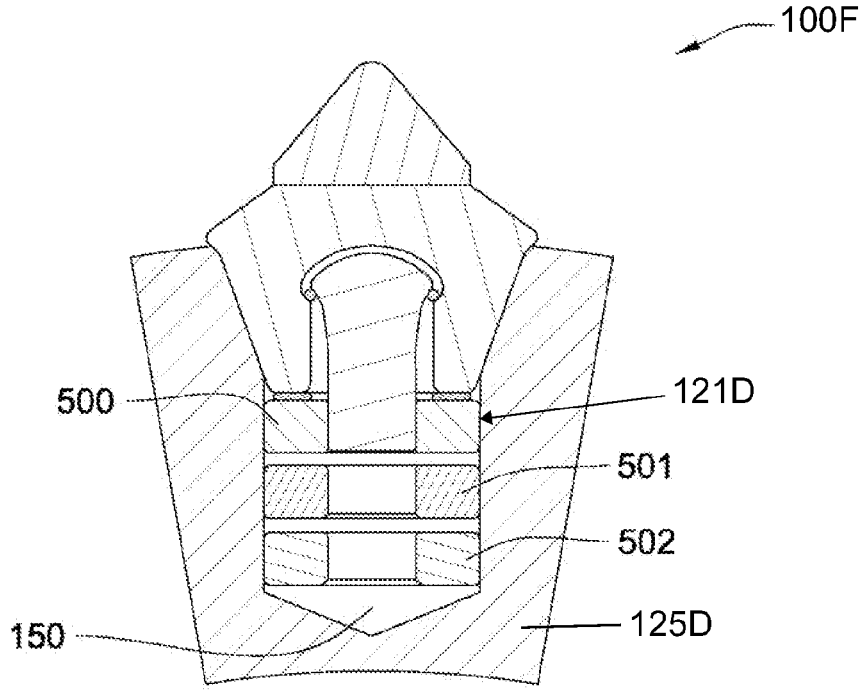
FIG. 5 is a cross-sectional view of another embodiment of a tool for use in a degradation assembly.

FIG. 5 shows another cross-sectional diagram of another embodiment of a tool 100F secured in the bore 121D of the driving mechanism of FIG. 3. A third tool 100F is shown in this embodiment. Previous anchors 501, 502, are shown disposed closer to the bottom 150D of the bore 121D than an anchor 500 used by the tool 100F in this embodiment.

Figure 6:
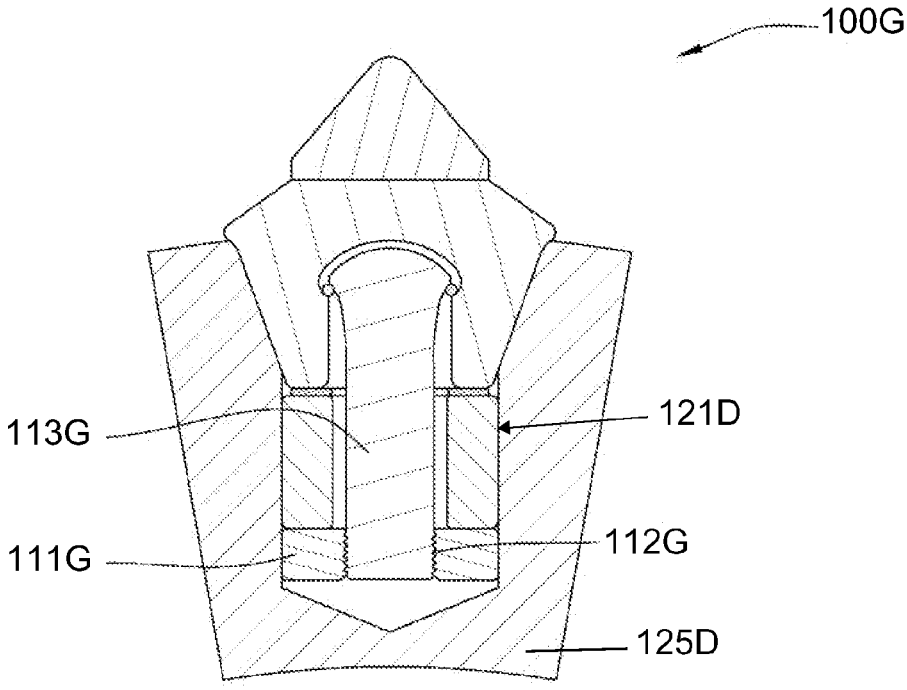
FIG. 6 is a cross-sectional view of another embodiment of a tool for use in a degradation assembly.

FIG. 6 shows another cross-sectional diagram of another embodiment of a tool 100G inserted in the bore 121D of the driving mechanism 125D of FIG. 3. A stem 113G is secured to an anchor 111G through a threadform 112G.

Figure 7:
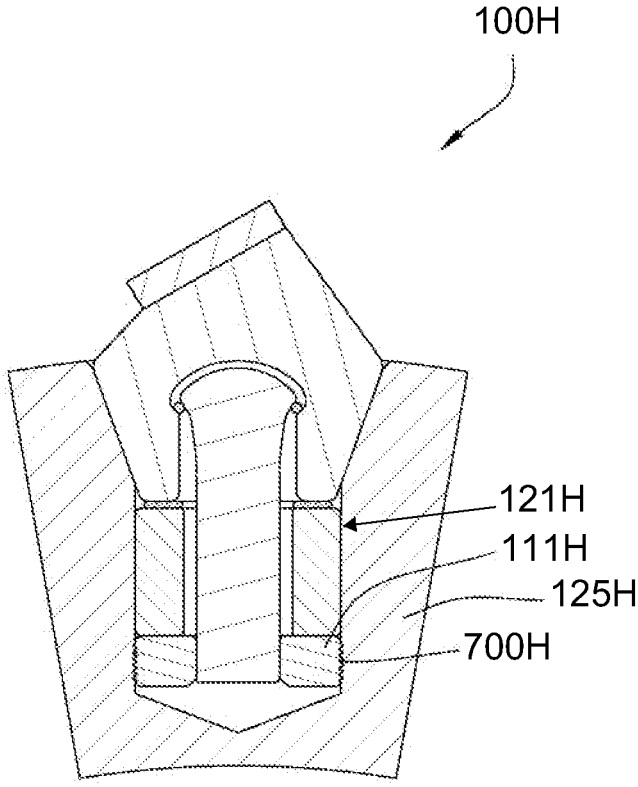
FIG. 7 is a cross-sectional view of another embodiment of a tool for use in a degradation assembly.

FIG. 7 shows another cross-sectional diagram of another embodiment of a tool 100H inserted in the bore 121D of the driving mechanism 125D of FIG. 3. The anchor 111H is secured to the driving mechanism 125H through a threadform 700H.

Figure 8:
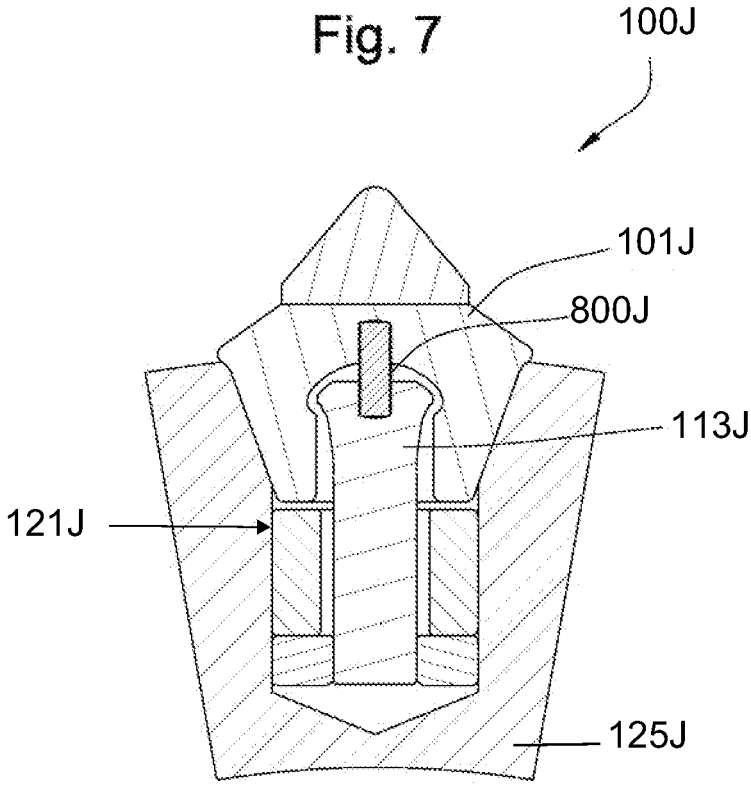
FIG. 8 is a cross-sectional view of another embodiment of a tool for use in a degradation assembly.

FIG. 8 shows another cross-sectional diagram of another embodiment of a tool 100J inserted in the bore 121D of the driving mechanism 125D of FIG. 3. The stem 113J is secured to the bolster 101J through a threadform 800J.

Figure 9A:
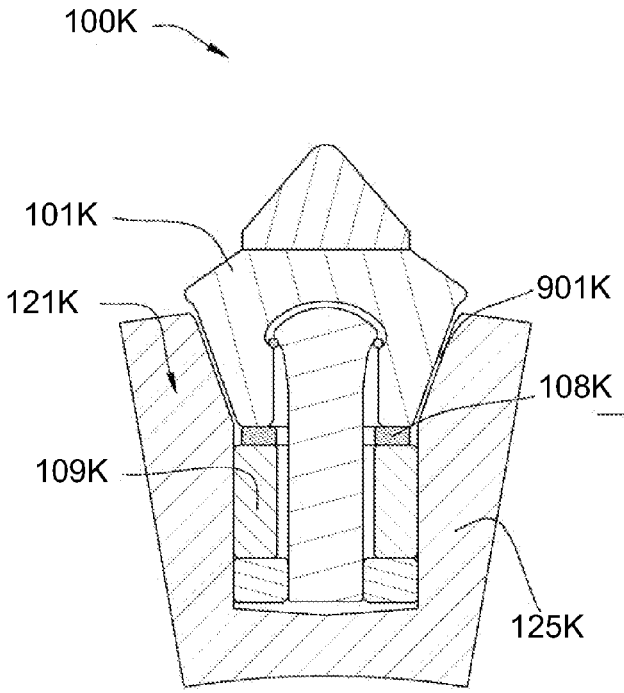
FIG. 9*a* is a cross-sectional view of another embodiment of a tool for use in a degradation assembly.

FIG. 9*a* shows another cross-sectional diagram of an embodiment of a tool 100K inserted in a bore 121K of a driving mechanism 125K. The tool 100K may be press fit into the bore 121K. A meltable spacer 108K is disposed between a bolster 101K and an insert 109K. The meltable spacer 108K may cause the bolster 101K to sit slightly elevated out of the bore 121K leaving a gap 901K intermediate the bolster 101K and the driving mechanism 125K.

Figure 9B:
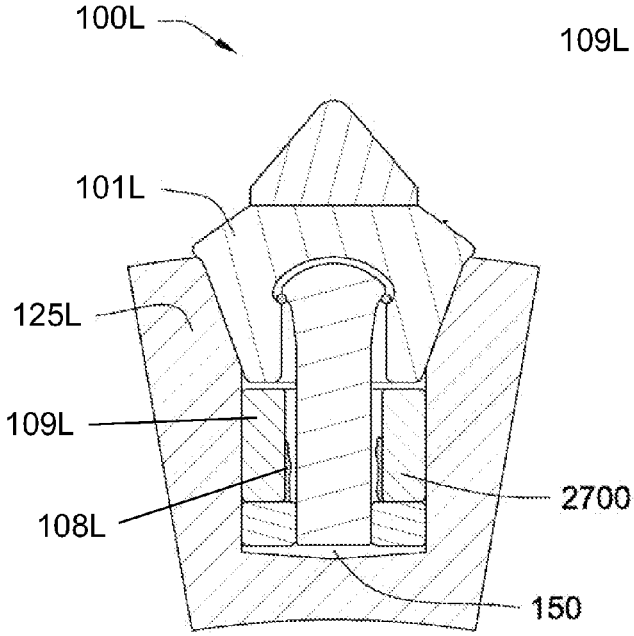
FIG. 9*b* is a cross-sectional view of another embodiment of a tool for use in a degradation assembly.

FIG. 9*b* shows another cross-sectional diagram of an embodiment of a tool 100L inserted in the bore 121K of the driving mechanism 125K of FIG. 9*a*. In the absence of a solid meltable spacer between a bolster 101L and an insert 109L (as shown in FIG. 9*a*), a tightening assembly, such as the tightening assembly 140A of FIG. 1 may pull the bolster 101L into the bore 121K and seat the bolster 101L against a tapered surface of the driving mechanism 125K. In some embodiments, a meltable spacer 108L may flow into a gap between a stem 113L and the insert 109L.

Figure 9C:
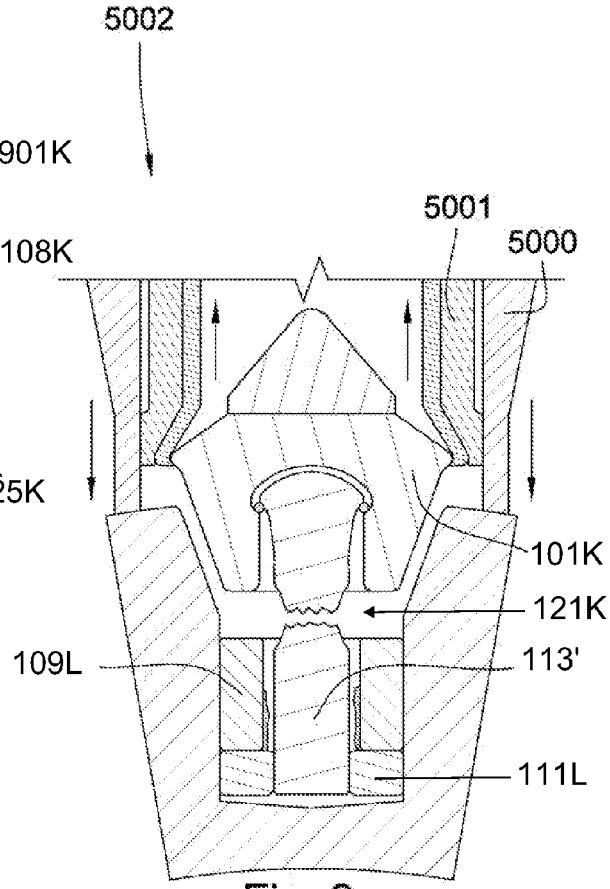
FIG. 9*c* is a cross-sectional view of another embodiment of a tool for use in a degradation assembly.

FIG. 9*c* discloses an embodiment of the bolster 101L of FIG. 9*b* being removed from the bore 121K. A puller 5002 comprises a first portion 5000 that braces against the driving mechanism 125K and a second portion 5001 that attaches to the bolster 101L and pulls on the bolster 101L. This movement breaks the stem 113L' and allows the bolster 101L to be recycled while leaving an anchor 111L in place. The stem 113L' and insert 109L may then be removed more easily. In other embodiments, another bolster (not shown) may be inserted into the bore 121K being tensioned off of another anchor (not shown) which is located above the previous anchor 111L.

Figure 10:
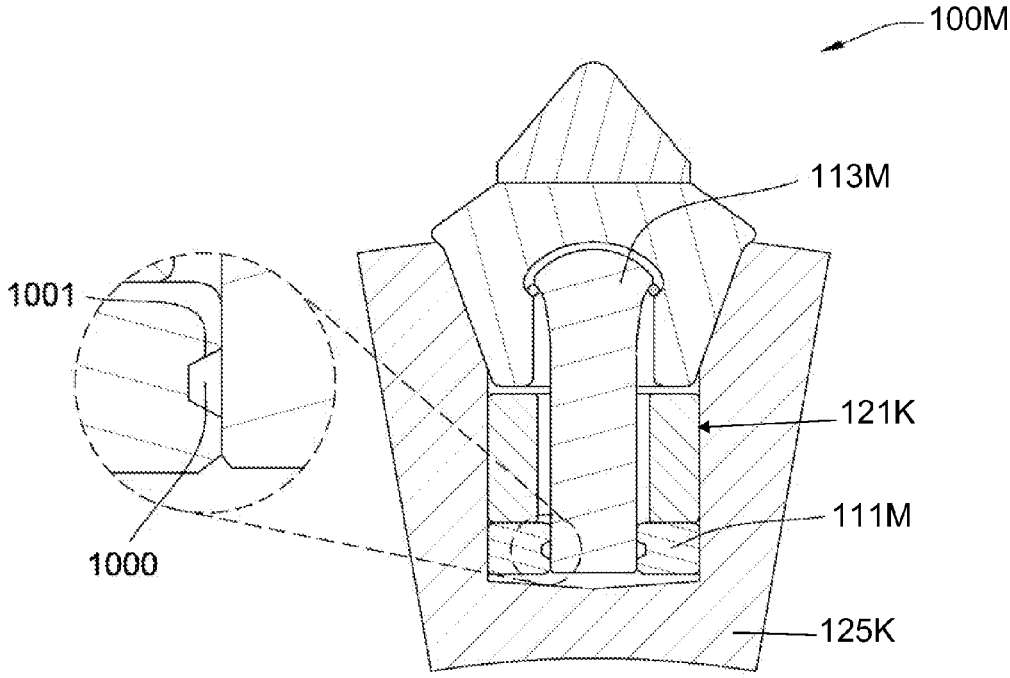
FIG. 10 is a cross-sectional view of another embodiment of a tool for use in a degradation assembly.

FIG. 10 shows another cross-sectional diagram of an embodiment of a tool 100M inserted in the bore 121K of the driving mechanism 125K of FIG. 9*a*. A stem 113M may comprise a radial protrusion 1000 adapted to interlock with a recess 1001 disposed in an anchor 111K. The interlocking radial protrusion 1000 and recess 1001 secure the anchor 111K to the stem 113K.

Figure 11:
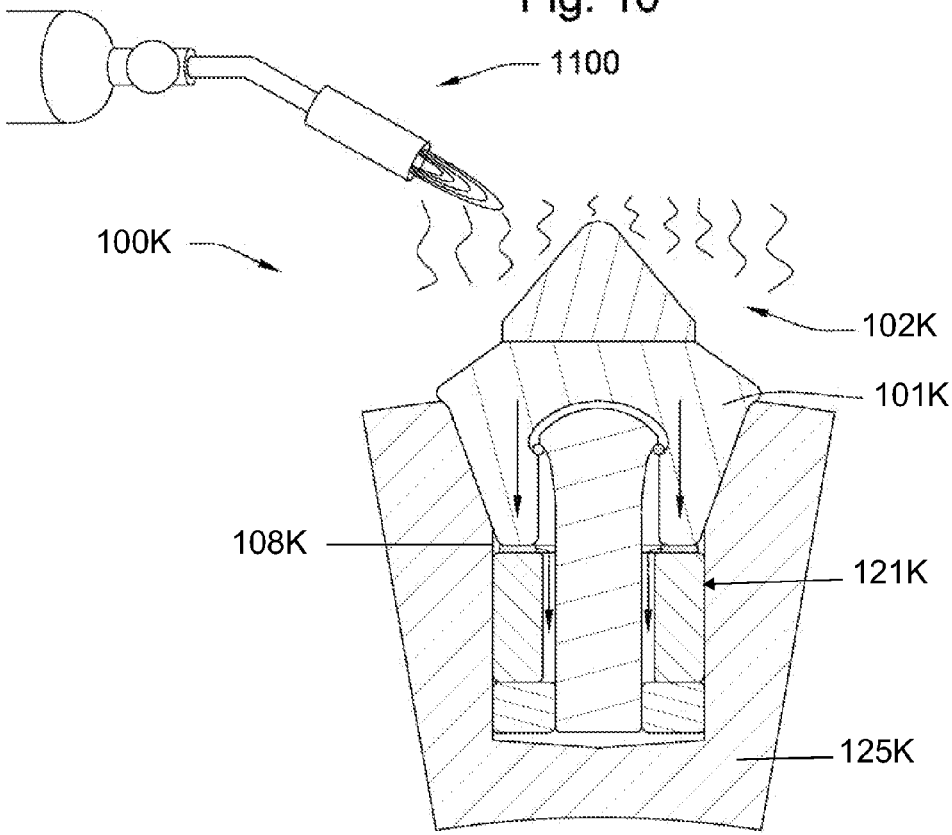
FIG. 11 is a cross-sectional view of another embodiment of a tool for use in a degradation assembly.

FIG. 11 shows another cross-sectional diagram of an embodiment of the tool 100K of FIG. 9 inserted in the bore 121K of the driving mechanism 125K. Heat is applied with a torch 1100 to an impact tip 102K and/or a bolster 101K to melt the meltable spacer 108K (shown in FIG. 9*a*). In some embodiments, the heat may be applied through a direct flame, radiant heat, furnace, heating coil, or combinations thereof.

Figure 12:
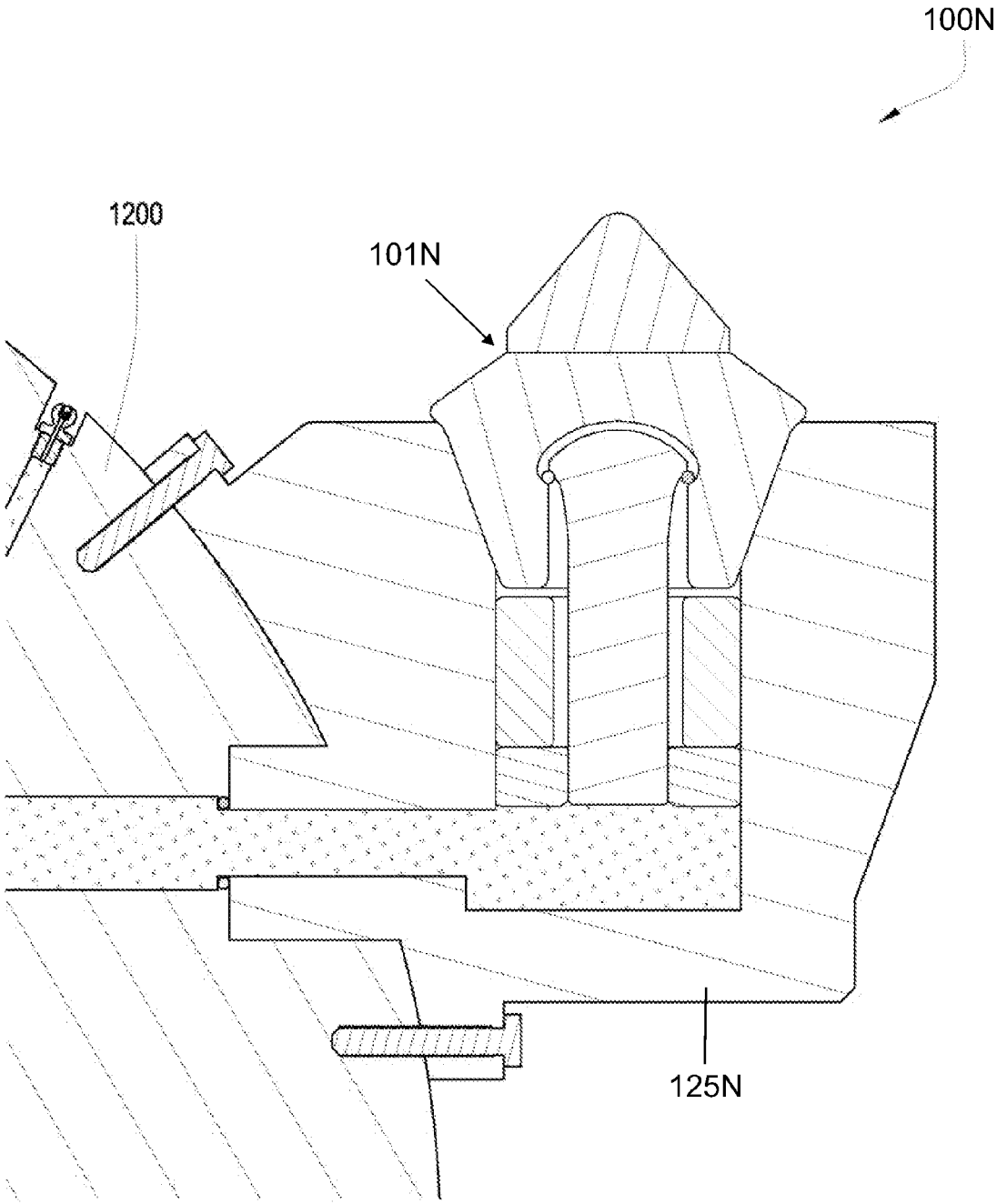
FIG. 12 is a cross-sectional view of an embodiment of a degradation assembly on a drum.

FIG. 12 shows another cross-sectional diagram of an embodiment of a degradation assembly 100N having a tool 101N. In this embodiment, the degradation assembly 100N is attached to a drum 1200 by way of drive mechanism 125N.

Figure 13:
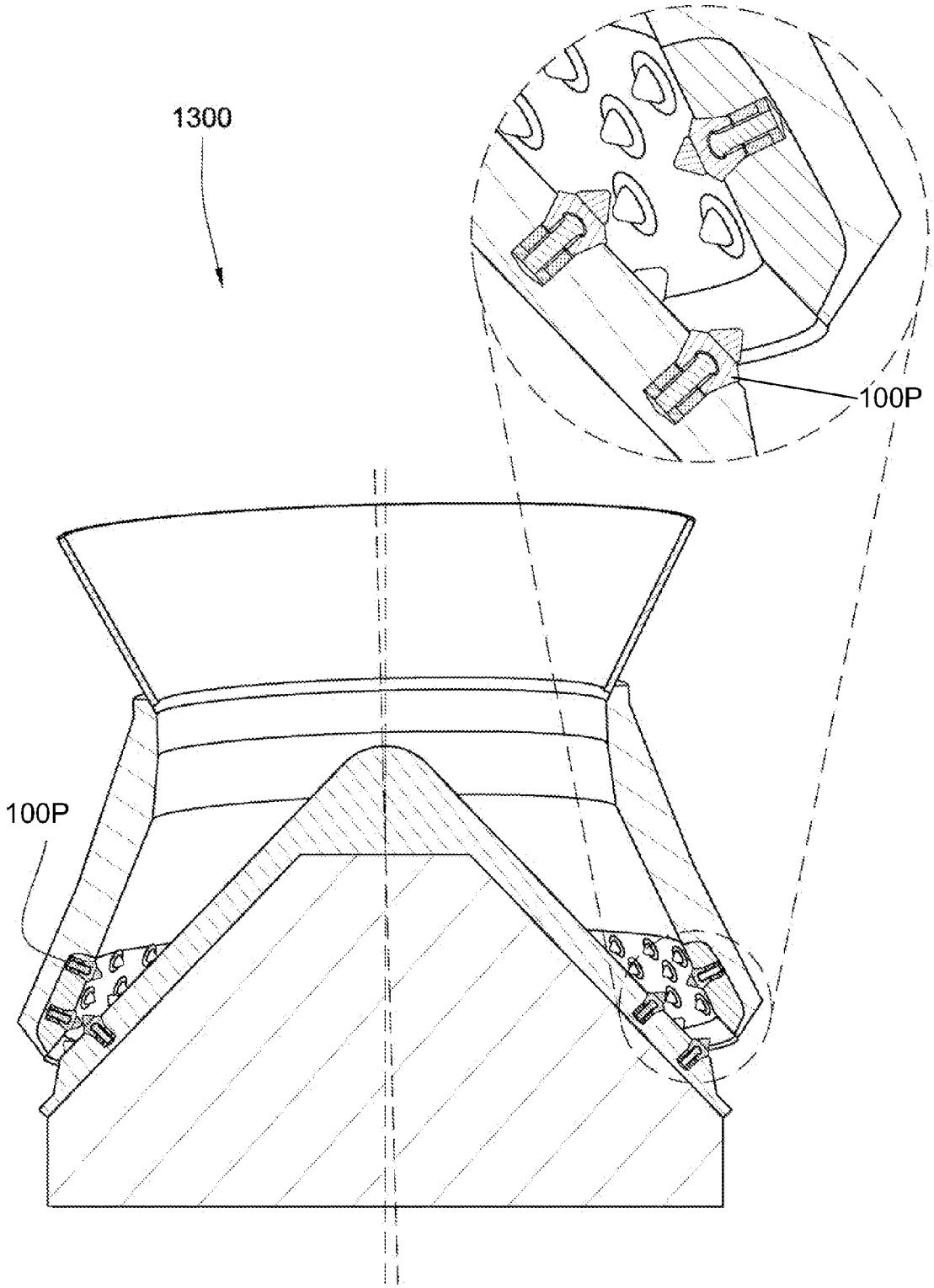
FIG. 13 is a cross-sectional view of an embodiment of a degradation assembly on a cone crusher.

FIG. 13 shows another cross-sectional diagram of an embodiment of a degradation assembly 100P. In this embodiment, the degradation assembly 100P is attached to a cone crusher 1300.

Figure 14:
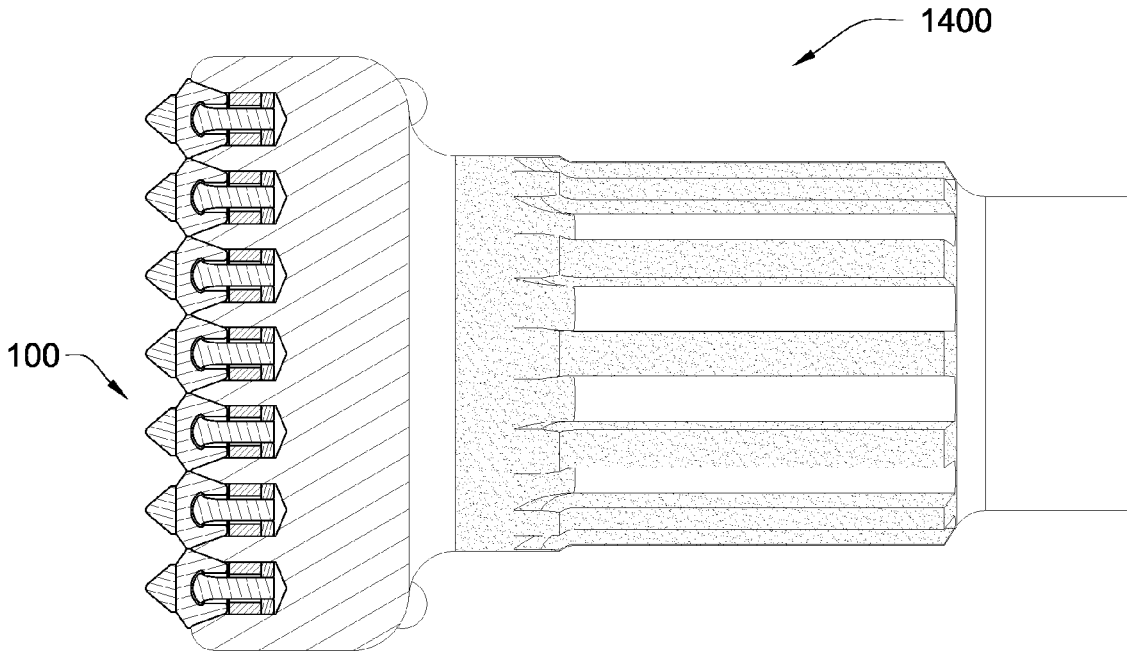
FIG. 14 is a cross-sectional view of an embodiment of a degradation assembly on a percussion bit.

FIG. 14 shows another cross-sectional diagram of an embodiment of a degradation assembly 100Q. In this embodiment, the degradation assembly 100Q is attached to a percussion bit 1400.

Figure 15:
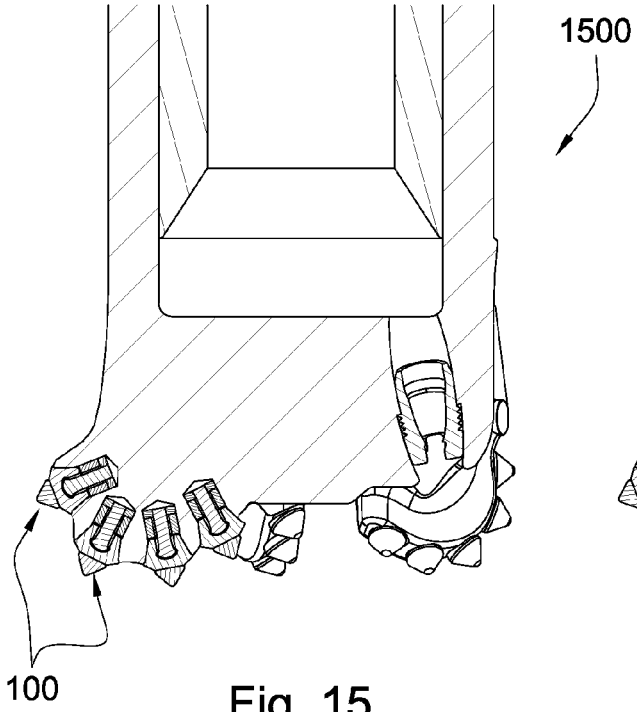
FIG. 15 is a cross-sectional view of an embodiment of a degradation assembly on a rotary drag bit.

FIG. 15 shows another cross-sectional diagram of an embodiment of a degradation assembly 100R. In this embodiment, the degradation assembly 100R is attached to a shear bit 1500.

Figure 15A:
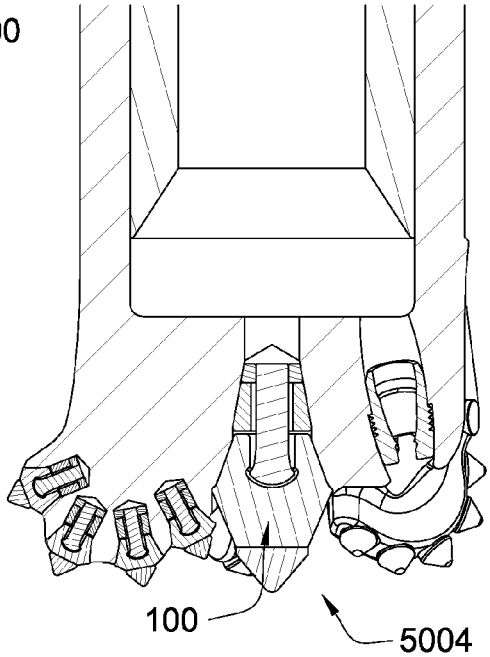
FIG. 15*a* is a cross-sectional view of another embodiment of a degradation assembly on a rotary drag bit.

FIG. 15*a* shows another cross-sectional diagram of an embodiment of a degradation assembly 100S which an assembly protruding beyond the face 5004 of the drill bit.

Figure 16:
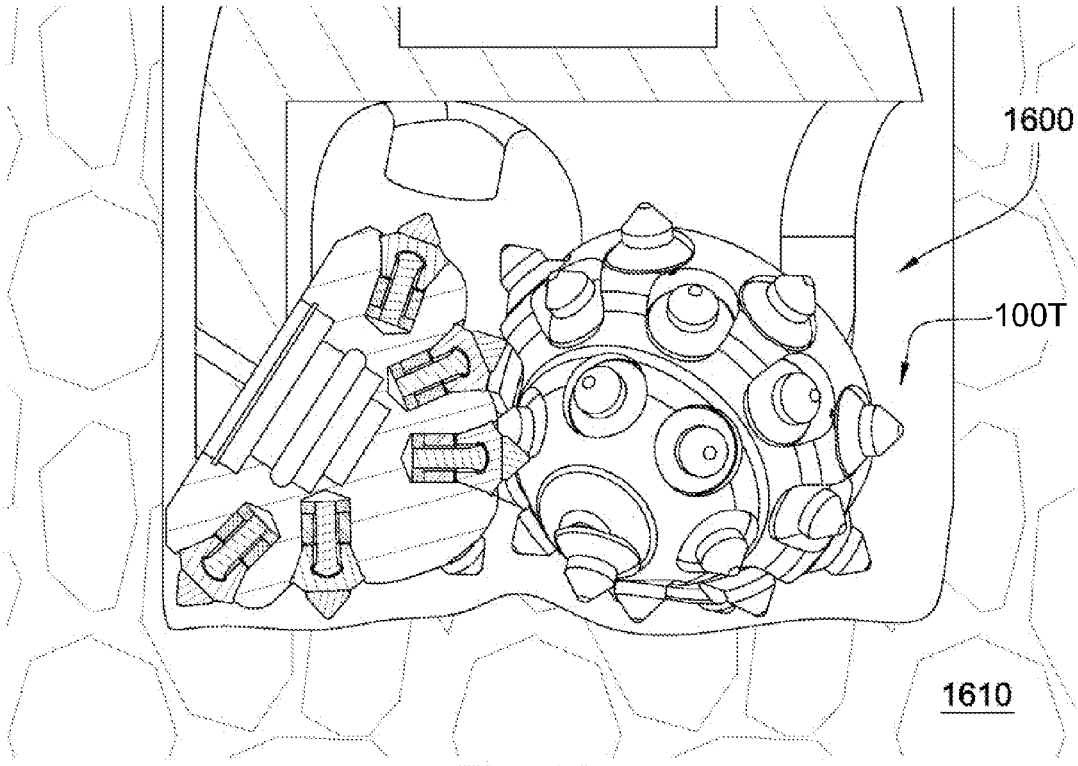
FIG. 16 is a cross-sectional view of an embodiment of a degradation assembly on a roller cone.

FIG. 16 shows another cross-sectional diagram of an embodiment of a degradation assembly 100T. In this embodiment, the degradation assembly 100T is attached to a roller cone 1600. The roller cone 1600 is shown degrading a formation 1610.

Figure 16A:
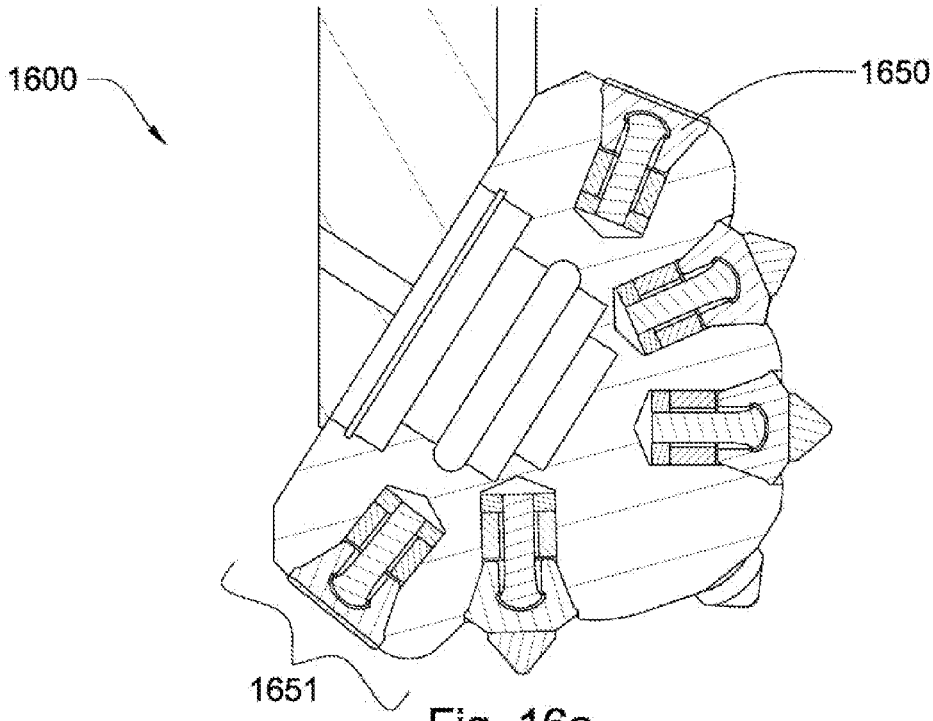
FIG. 16*a* is a cross-sectional view of another embodiment of a degradation assembly on a roller cone.

FIG. 16*a* discloses another embodiment of a roller cone. The gauge insert 1650 in this embodiment is a flat and adapted to reduce wear on the gauge row of the roller cone. Although not shown, in some embodiments, the inserts may be enhanced with a harder material such as polycrystalline diamond, cubic boron nitride, hard facing, carbide, or combinations thereof.

Figure 17:
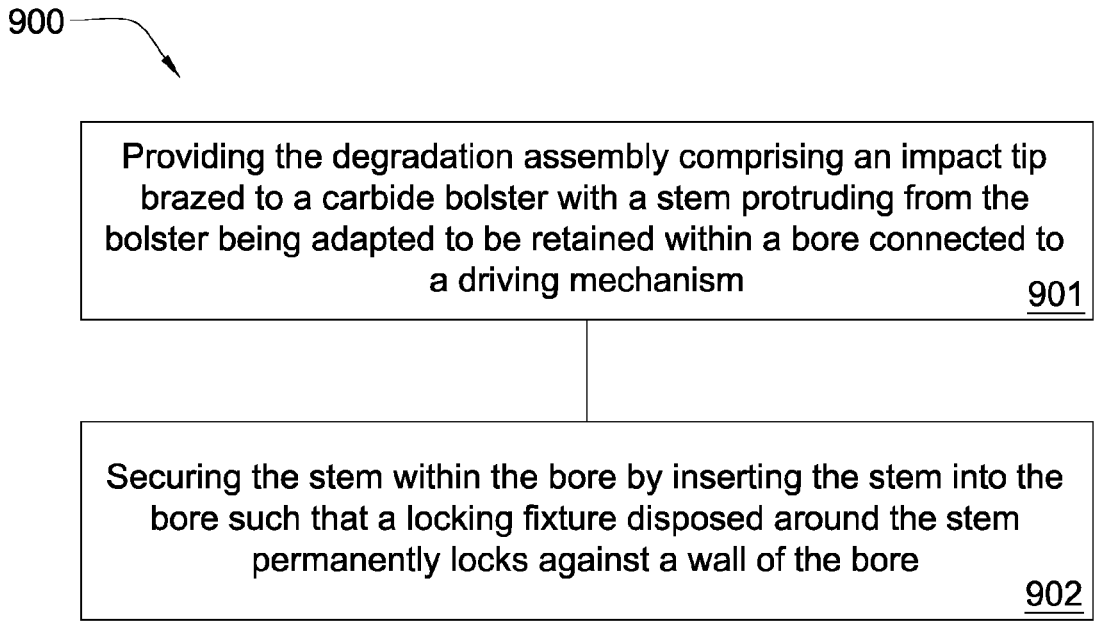
FIG. 17 is an embodiment of a method for assembling a degradation assembly.

FIG. 17 is an embodiment of a method 900 for assembling a tool, such as the tool 100A of FIG. 1. Referring to FIG. 1, the method 900 may include the steps of providing 901 the tool 100A comprising an impact tip 102A brazed to a carbide bolster 101A with a stem 113A protruding from the bolster 101A being adapted to be retained within a bore 121A connected to a driving mechanism 125A; securing 902 the stem 113A within the bore by inserting the stem 113A into the bore 121A such that a locking fixture disposed around the stem 113A permanently locks against a wall of the bore 122A.

Figure 18:
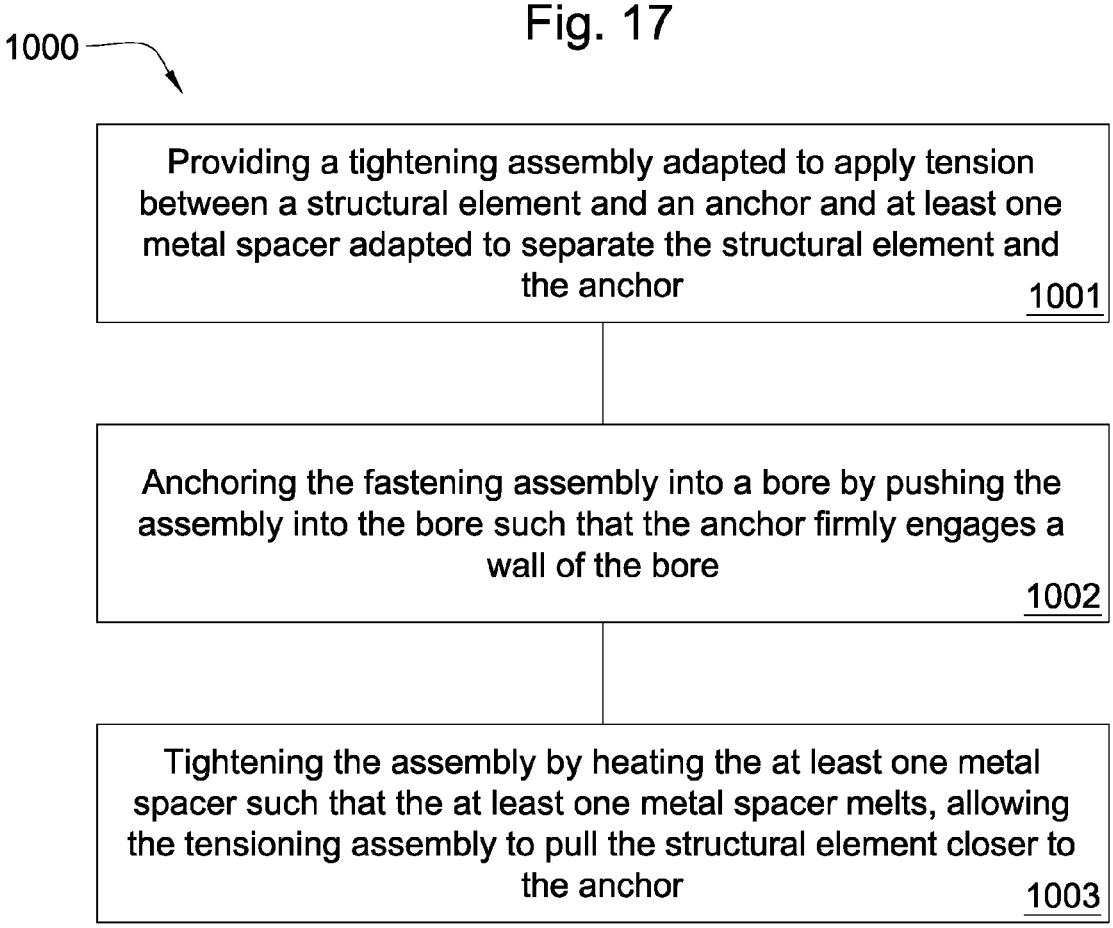
FIG. 18 is an embodiment of a method for tightening a degradation assembly.

FIG. 18 is an embodiment of a method 1000 for tightening a tool such as the tool 100 of FIG. 1. Referring to FIG. 1, the method 1000 may include the steps of providing 1001 a tightening assembly 140A adapted to apply tension between a structural element 101A and an anchor 111A and at least one meltable spacer 108A adapted to separate the structural element 101A and the anchor 111A; anchoring 1002 the tightening assembly 140A into a bore 121A by pushing the assembly 100A into the bore 121A such that the anchor 111A firmly engages a wall of the bore 122A; tightening 1003 the assembly 100A by heating the at least one meltable spacer 108A such that the at least one meltable spacer 108A melts, allowing the tightening assembly 140A to pull the structural element 101A closer to the anchor 111A.

Figure 19:
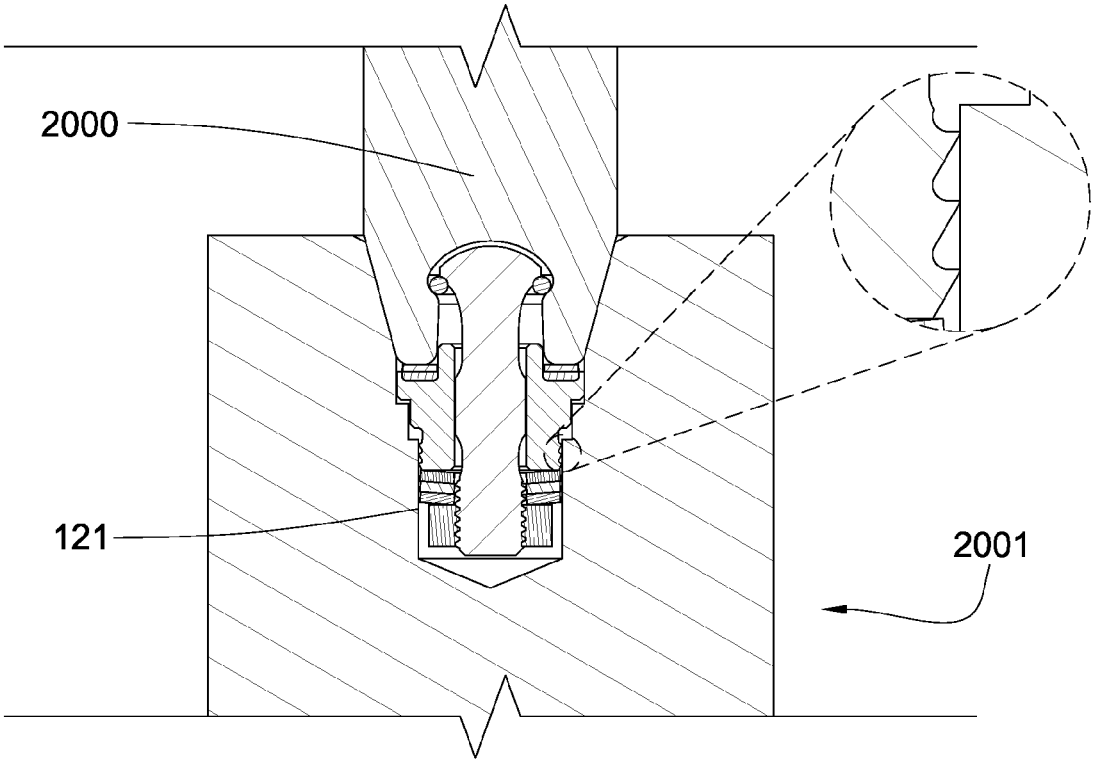
FIG. 19 is view of an embodiment of a fastening assembly.

FIG. 19 discloses a structural element 2000 secured within a bore similar to how the stem is secured within the bore in FIG. 1. The bore 121U may be formed in a driving mechanism, a frame, a wall, a floor, a support, a vehicle, a bolster, table or combinations thereof. The structural element 2000 may be a component of the overall structure which is tightly secured to the bore 121U.

Figure 20:
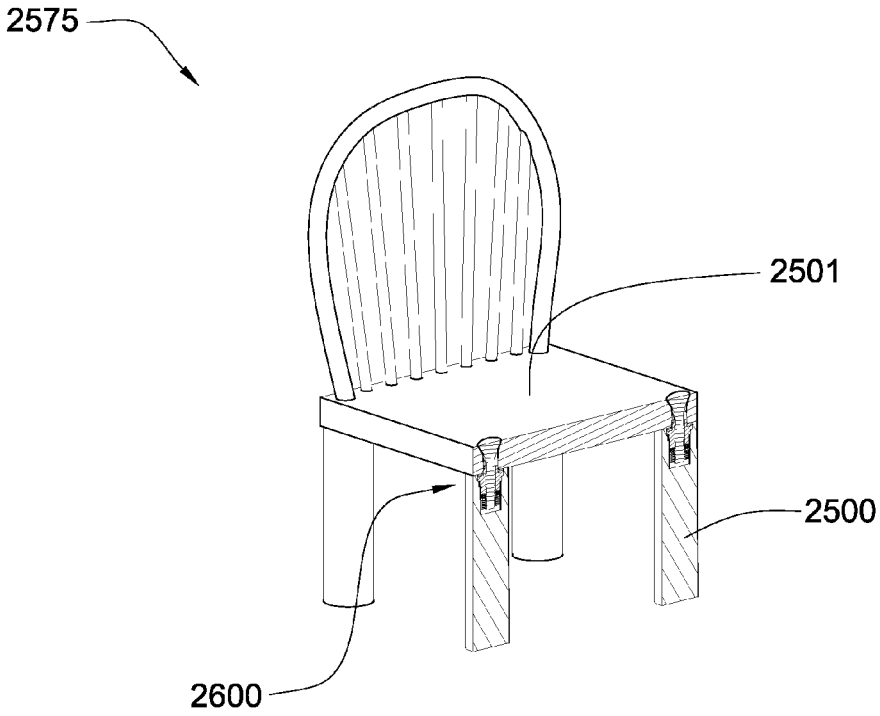
FIG. 20 is a view of another embodiment of a fastening assembly.

FIG. 20 discloses the fastening mechanism 2600A connecting a chair leg 2500 to a chair seat 2501.

Figure 21A:
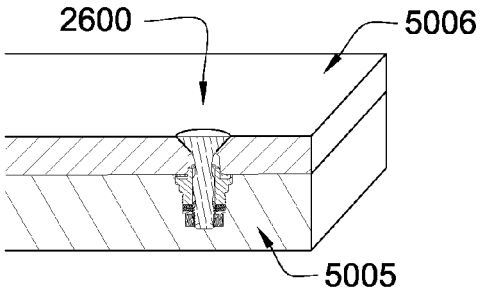
FIG. 21*a* is a view of another embodiment of a fastening assembly.

FIG. 21*a* discloses two boards 5006 being held together with a fastening assembly 2600B through a blind hole 5005.

Figure 21B:
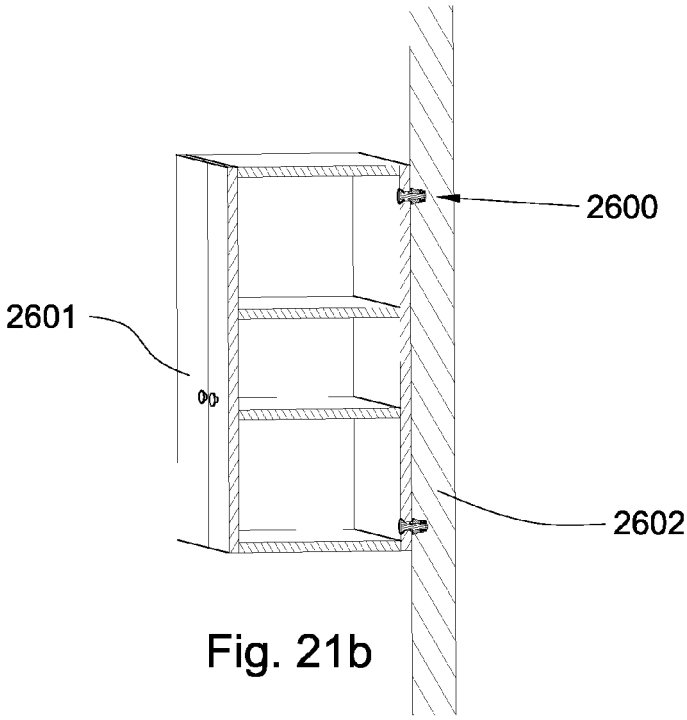
FIG. 21*b* is a view of another embodiment of a fastening assembly.

FIG. 21*b* discloses a fastening mechanism 2600C connecting a cabinet 2601 to a wall 2602. The fastening mechanism 2600A may be used to connect any structure to another, especially where the connection involves a blind hole.

Figure 22:
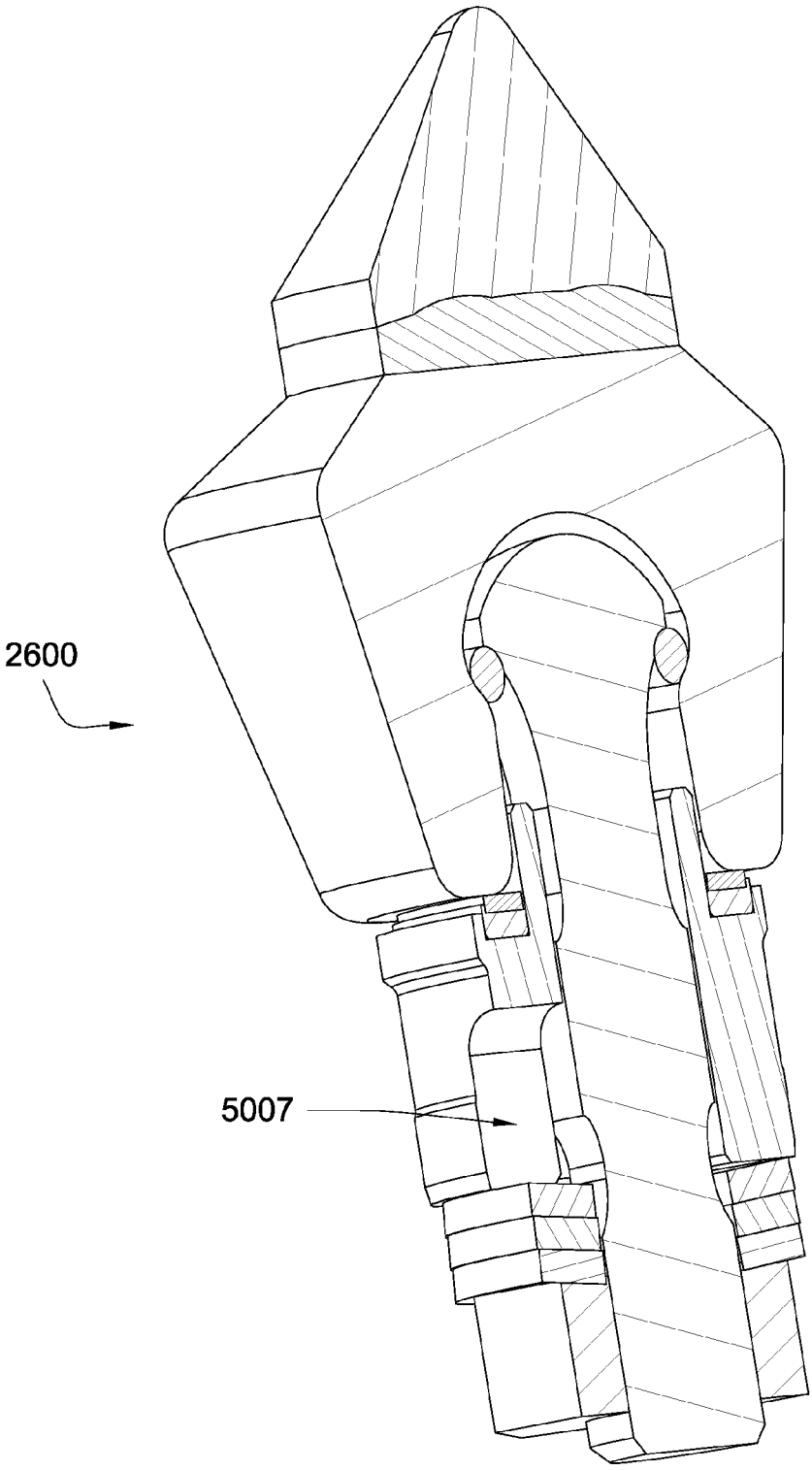
FIG. 22 is a cross-sectional view of another embodiment of a fastening assembly.

FIG. 22 discloses another embodiment of a fastening mechanism 2600D. In this embodiment, the anchor comprises at least one slot 5007, which provides a radial spring force adapted to hold the anchor against the wall of the bore. In this embodiment, the springs are between the anchor and an insert.

Whereas the present invention has been described in particular relation to the drawings attached hereto, it should be understood that other and further modifications apart from those shown or suggested herein, may be made within the scope and spirit of the present invention.

What is claimed is:

1. A fastening method anchoring a fastening assembly to a degradation assembly, comprising the steps of:

providing a fastening assembly adapted to apply tension between a structural element and an anchor and at least one meltable spacer adapted to separate the structural element and the anchor;

anchoring the fastening assembly into a bore by pushing the assembly into the bore such that the anchor firmly engages a wall of the bore;

tightening the assembly by heating the at least one meltable spacer such that the at least one meltable spacer melts, allowing the tensioning assembly to pull the structural element closer to the anchor.

2. The method of claim 1, wherein the wall of the bore is substantially cylindrical.

3. The method of claim 1, wherein the structural element is a bolster that supports an impact tip.

4. The method of claim 1, wherein the anchor is a nut.

5. The method of claim 1, wherein the tensioning assembly comprises a spring adapted to apply tension on the structural element and the anchor.

6. The method of claim 1, wherein the tensioning assembly comprises a stem in mechanical communication with both the anchor and the structural element.

7. The method of claim 6, wherein the stem is interlocked with the structural element through a snap ring.

8. The method of claim 6, wherein the stem is interlocked with the anchor through a threadform.

9. The method of claim 6, wherein the stem is interlocked with the structural element through at least one catch.

10. The method of claim 6, wherein the stem comprises a radial protrusion.

11. The method of claim 10, wherein the anchor comprises a complimentary recess adapted to interlock with the radial protrusion.

12. The method of claim 1, wherein the at least one meltable spacer comprises a metal selected from a group comprising lead, bismuth, tin, cadmium, wax, plastic or combinations thereof.

13. The method of claim 1, wherein the at least one meltable spacer is adapted to allow the structural element to move closer to the anchor when melted.

14. The method of claim 1, wherein the step of tightening the assembly comprises applying heat to the meltable spacer through the impact tip.

15. The method of claim 1, wherein the anchor is rigidly attached to the bore through a press fit.

16. The method of claim 1, wherein the step of tightening the assembly comprises tightening such that a tapered portion of the structural element seats against a portion of the bore.

17. The method of claim 1, wherein the at least one meltable spacer melts at a temperature lower than the anchor.

18. The method of claim 1, wherein the anchor is rigidly attached to the bore through a barb.

19. The method of claim 1, wherein the anchor is rigidly attached to the bore through a threadform.

20. The method of claim 1, wherein the step of anchoring the fastening assembly into the bore comprises press-fitting the assembly into the bore.

* * * * *

UNITED STATES PATENT AND TRADEMARK OFFICE

CERTIFICATE OF CORRECTION

PATENT NO. : 7,871,133 B2
APPLICATION NO. : 12/112815
DATED : January 18, 2011
INVENTOR(S) : David R. Hall et al.

It is certified that error appears in the above-identified patent and that said Letters Patent is hereby corrected as shown below:

On the Title Page

Left column, item (63), line 2, under "Related U.S. Application Data", after "which is a" replace "continuation" with --continuation-in-part--.

Left column, item (63), line 9, under "Related U.S. Application Data", before "of application No. 12/021,019" replace "continuation-in-part" with --continuation--.

Signed and Sealed this
Twenty-third Day of April, 2013

Teresa Stanek Rea
*Acting Director of the United States Patent and Trademark Office*